US005533731A

United States Patent [19]

Koenig

[11] Patent Number: 5,533,731

[45] Date of Patent: Jul. 9, 1996

[54] EDUCATIONAL DEVICE EMPLOYING GAME SITUATION

[76] Inventor: Stephen Koenig, 11207 Watermill La., Silver Spring, Md. 20902

[21] Appl. No.: 374,369

[22] Filed: Jan. 18, 1995

[51] Int. Cl.[6] ..... A63F 3/00

[52] U.S. Cl. ..... 273/243

[58] Field of Search ..... 273/242, 243, 273/236, 248, 249

[56] References Cited

U.S. PATENT DOCUMENTS

| | | | |
|---|---|---|---|
| 3,952,423 | 4/1976 | Gentry . | |
| 4,121,823 | 10/1978 | McBride . | |
| 4,178,700 | 12/1979 | Dickey . | |
| 4,198,055 | 4/1980 | Imatt . | |
| 4,201,388 | 5/1980 | Cantelon . | |
| 4,815,976 | 3/1989 | Krane | 273/243 X |
| 4,966,371 | 10/1990 | Sherman | 273/243 |
| 4,971,561 | 11/1990 | Krane | 273/243 X |
| 5,042,816 | 8/1991 | Davis et al. . | |
| 5,071,133 | 12/1991 | Smith . | |
| 5,104,127 | 4/1992 | Whitney | 273/243 |
| 5,152,535 | 10/1992 | Roberts . | |
| 5,224,862 | 7/1993 | Sullivan . | |
| 5,228,860 | 7/1993 | Hale . | |
| 5,257,939 | 11/1993 | Robinson et al. . | |
| 5,295,834 | 3/1994 | Saunders . | |
| 5,318,447 | 6/1994 | Mooney . | |

*Primary Examiner*—William E. Stoll
*Attorney, Agent, or Firm*—Lowe, Price, LeBlanc & Becker

[57] ABSTRACT

An educational game of chance based primarily on the Biblical books of Leviticus and Numbers. The game includes a rectangular board with a continuous path around the perimeter. A central area is comprised of a representation of Solomon's Temple and Courtyard. The game includes an Oracle consisting of two spinners, a plurality of sacrificial animal, grain and wine cards, Revelation and Abomination cards, money, A Table of Sacrifices, a three dimensional Altar, and an instruction manual with tables and explanations for the various events of the game. Through the course of the game, events occur which call for specific types of sacrifices or other rituals. Sacrifices are purchased and then offered. Eventually, a sacrifice is not accepted and the player is consumed by strange fire. The last player remaining is the winner.

17 Claims, 4 Drawing Sheets

EDUCATIONAL DEVICE EMPLOYING GAME SITUATION

BACKGROUND OF THE INVENTION

1. Technical Field

The present invention relates to learning units which impart initial and reinforcement knowledge in a game environment more specifically directed to teaching the principles and precepts of the Biblical Books of Leviticus and Numbers in a game format.

2. Background of the Related Art

Instruction relating to the Book of Leviticus and Numbers is difficult because the language and customs of that time are far different from our own time. The subject matter is widely regarded as irrelevant and uninteresting.

It is therefore a broad object of the game to make the rituals and precepts real and interesting through personal "experience".

A further object of the invention is to impart a mass of information to those with absolutely no background in the subject. Specifically to familiarize the player with the names and uses of the sacrifices, the Holydays, and various elements of the ritual life in the Bible.

Still yet another object is to provide a game playable by one or more players. An additional object is to provide a board game simple enough for all ages.

Yet another object is to provide humor and entertainment by contemporizing various activities and in some cases by providing anachronisms. The present invention is susceptible to embodiment in many different forms. There is shown in the drawings and will be described in detail a specific embodiment which is to be considered an exemplification with the understanding that the principles of the invention are not intended to limit the invention to the embodiment illustrated.

SUMMARY OF THE INVENTION

The invention is a board game for familiarizing players with the sacrificial rites of the Biblical Book of Leviticus and Numbers. Players consult a random chance device which indicates movement on the board, whether or how the activity of a space or card is to be observed, and the outcome of various tables. If a sacrifice is required, appropriate animals cards are purchased from the Money Changer and given to the High Priest who places the card or cards on the Altar. The player then operates the random chance device which results in forward or backward movement or an inconclusive result which requires resolution by the Table of Sacrifices. The game is lost if the Table of Sacrifices results in "Strange Fire." Sometimes an event, such as Gossip, requires consultation with the Priestly handbook which directs the player to the article on Leprosy which in turn summarizes the symptoms and provides a table used in conjunction with the oracle to determine if Leprosy exists in the player. If so the appropriate offering and methodology for restoring ritual purity is presented. Each game board space, Revelation and Abomination card have Biblical activities or events or activities which if not found in the Bible are resolved by application of Biblical principles. An added level of difficulty is introduced by setting aside up to three tithes from income.

DESCRIPTION OF THE PREFERRED EMBODIMENTS OF THE INVENTION

Figure 1A:
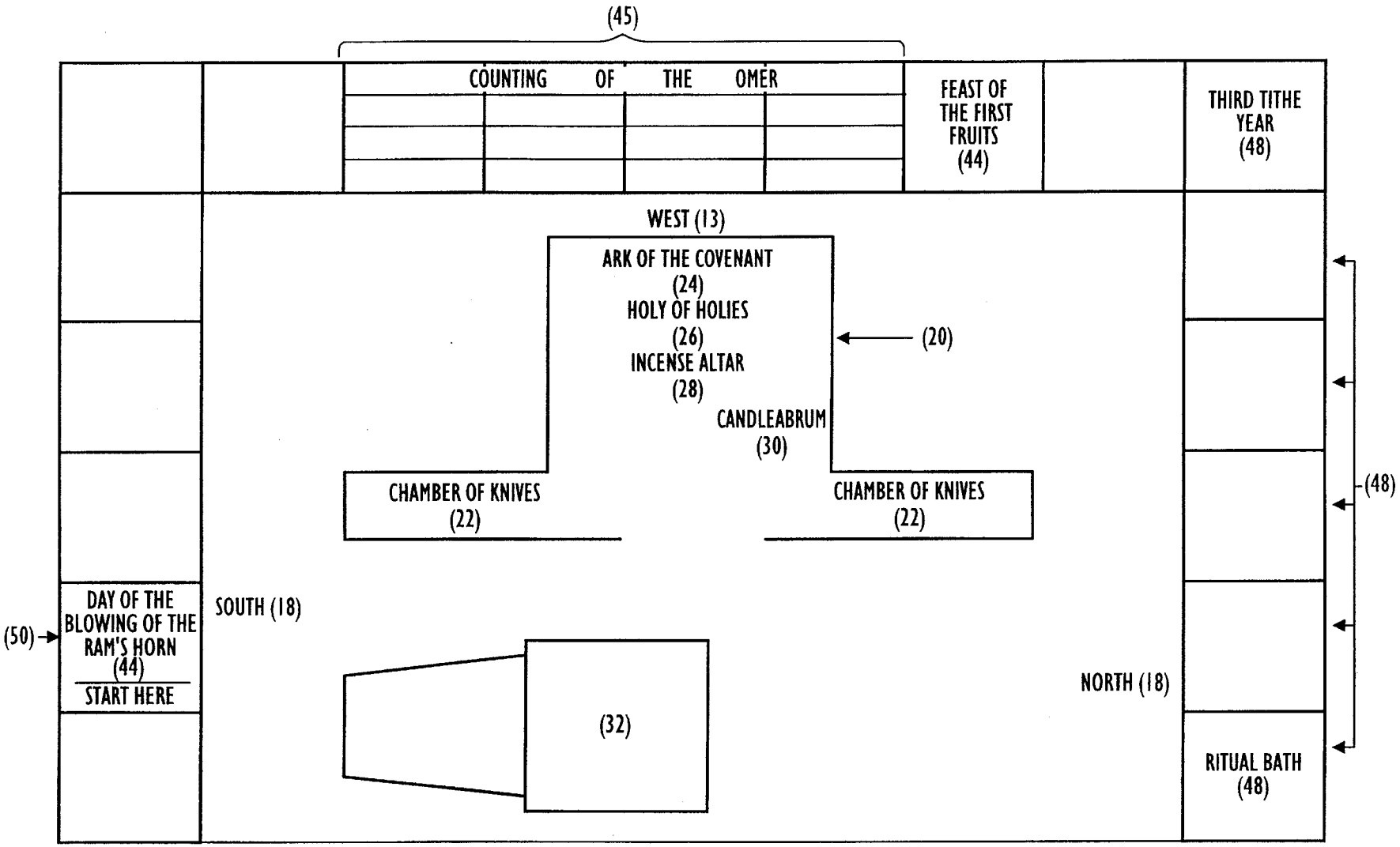
FIG. 1 is a top plan view of the game board of the present invention.
Figure 1B:
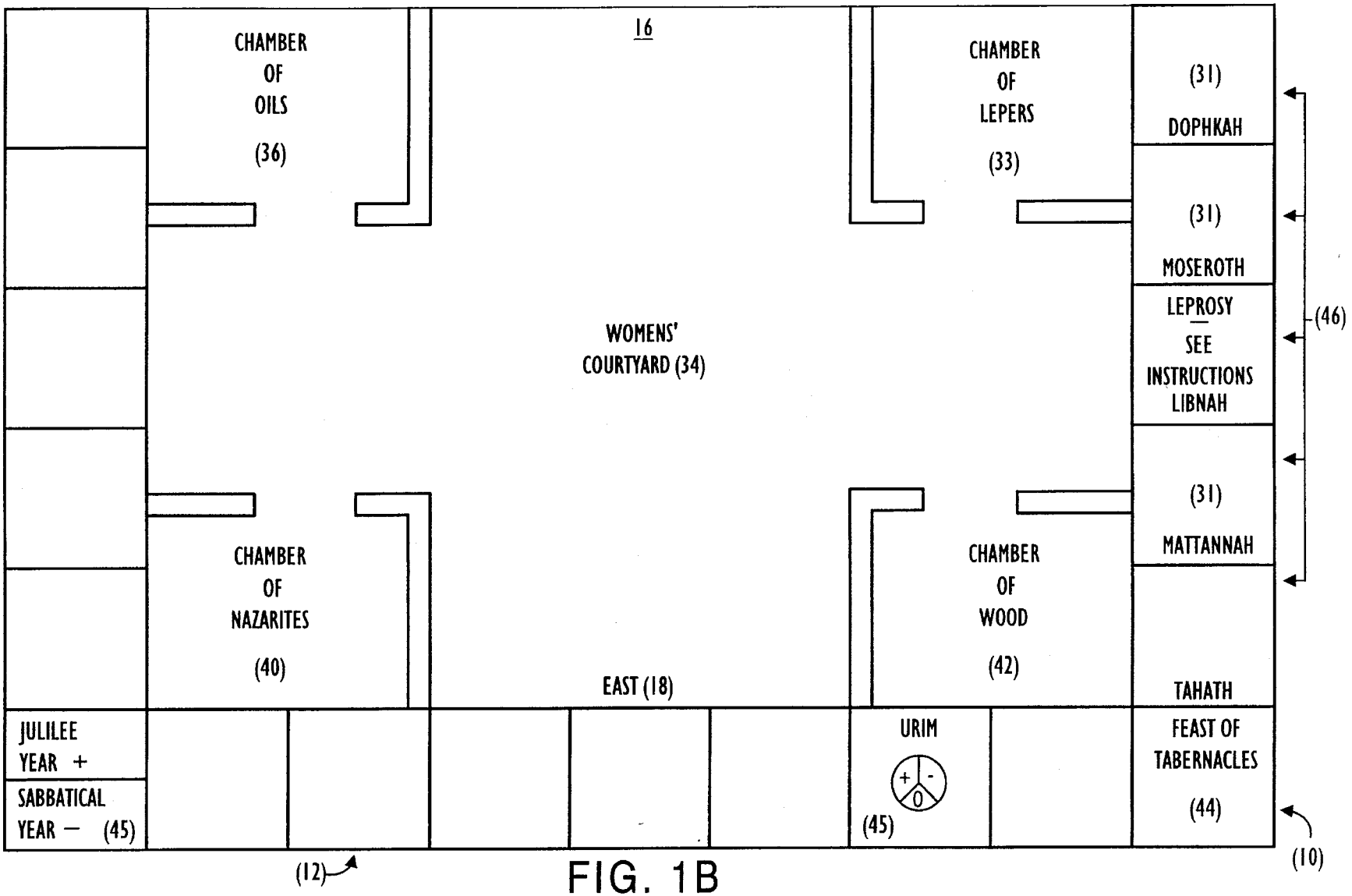

The invention is intended to provide players with a reenactment or simulation of the sacrificial rituals. Referring to FIG. 1 is a top plan view of the game apparatus (10) in accordance with the present invention. The game apparatus (10) is generally comprised of a board (12) having around the perimeter thirty-eight contiguous spaces (14) enclosing a central area (16). The central area (16) contains indicia of North, South, East and West (18). On the western side of the board is contained a line representation of the Temple floor plan (20.) The Temple floor plan has two chambers labeled Chamber of Knives (22). The central area of the Temple has the following indicia: "Ark of the Covenant" (24), "Holy of Holies" (26), "Incense Altar" (28), "Candelabrum" (30). To the east of the Temple floor plan is a line drawing of the Altar (32) On the eastern side of the board is an area labeled "Womens' Courtyard" (34). In the four corners "of the Womens' Courtyard" are four spaces labeled "Chamber of Oils" (36), "Chamber of Lepers" (38), "Chamber of Nazarites" (40), and "Chamber of Woods" (42). The spaces around the perimeter (14) are of three categories of spaces:

Each of the different chambers are segregated by one another, preferably using walls which extend in a vertical upward direction with respect to the gameboard and which are affixed thereto. In addition, each of the different chambers are positioned with respect to each other in accordance with the biblical designations to further enhance the teaching aspects of the game for the players. For example, the priest first enters the basic chamber of the temple which is only considered Holy and subsequently enters the holy of holies area (26).

REGULAR SPACES (46): "Fall Harvest", "Redeem Self from Vow", "Gossip", "Menstrual Infirmity", "Purchase Slaves from among Children of Resident Aliens", "Return from Voyage on Sea", "Obtain Additional Wife", "Leprosy", "Recover from Serious Illness", "Emission of Semen", "Have Baby Girl", "Have Baby Boy", "Spring Harvest", "Sell Bowls of Fermented Sheep Milk", "Liberated from Prison", "Return from Trip in the Desert", "Second Passover". To enhance the educational value of the game board, illustrated in FIG. 1, each of the regular spaces (46) bear the names (31) of a different Habitation from the Book of Numbers. Four of the Regular Spaces are shaded and labeled "Counting of the Omer" (45) for pedagogical purposes.

HOLYDAY SPACES (44): "Passover", "Days of Unleavened Bread", "Feast of the First Fruits", "Day of the Blowing of the Ram's Horn", "Day of Atonement", "Feast of Tabernacles", "Eighth Day Assembly", "New Moon", "Sabbath". The Holyday spaces (44) are distinguished by red lettering.

MISCELLANEOUS SPACES (48): "Third Tithe Year", "Ritual Bath", "Jubilee/Sabbatical Year" "Urim".

Figure 2:
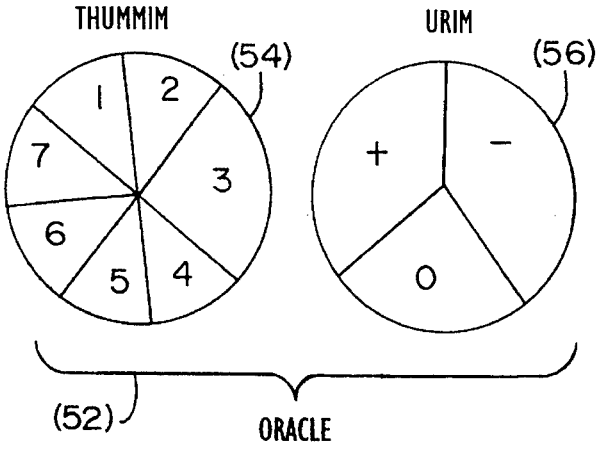
FIG. 2 illustrates a dual aspect chance device.

The game apparatus (10) further comprises a chance device FIG. 2, referred to as an Oracle (52) and as "The Breastplate of Decision: "Thummim" and "Urim"", The Oracle (52), is constructed with two spinners which are designed in such a way as to give an occasional inconclusive answer thereby requiring a resolution by the Table of Sacrifices (58). The spinner labeled "Thummim" (54) is labeled from one to seven and is used for two purposes: First, to determine the number of spaces to move the Markers (62) along the continuous path on the Board (14). Secondly, "Thummim" (54) is used in conjunction with "Urim" (56) to determine the outcome of table references as described hereafter. The spinner "Urim" (56) has three symbols: "+", "–", "O" and has various functions: First, regular spaces (46), "Abomination Cards" (70), and "Revelation Cards" (72) are activated only when "Urim" (56) a returns "+" symbol. A second use of "Urim" (56) is to determine the direction of movement when a personal or community sacrifice is made. If an "O" results during a personal sacrifice the Table of Sacrifices is to be consulted. A third use of "Urim" is to determine whether an Abomination Card or a Revelation card is to be selected when landing on an "Urim" space. A fourth use of "Urim" is to determine whether the "Sabbatical Year" or the "Jubilee Year" rules are in effect.

Figure 3:
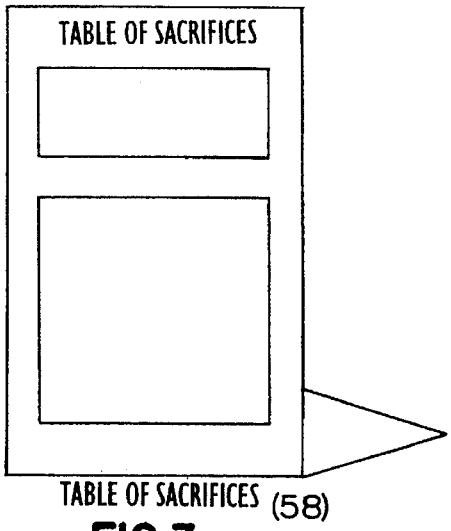
FIG. 3 is a view of the Table of Sacrifices.

FIG. 3 The Table of Sacrifices is constructed of cardboard with cardboard supports in a three dimensional shape of a table and affixed to the game board to create a free standing chart to be referred to constantly during the game. The Table of Sacrifices is divided into two charts. The top chart is subdivided into five columns which have the indicia of the five Sacrifices transliterated from Hebrew to English: "OLAH", "MINCHA", "SHELAMIM", "CHATTAS", "ASHAM". The bottom chart is divided into five columns corresponding to the above categories. The lower table is further divided into seven rows. The resulting grid generates further instructions based on the spin of "Thummim" (54).

Figure 4:
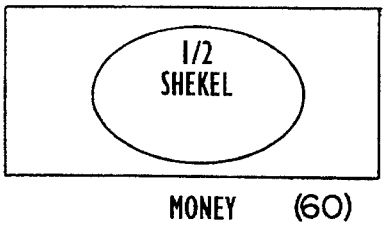
FIG. 4 illustrates the money.

Looking at FIG. 4 can be seen a representation of paper money or coins denominated in shekels. Paper money, (an anachronism) is required to purchase sacrifice cards, for tithing, situations involving indebtedness and an assortment of other transactions.

Figure 5:
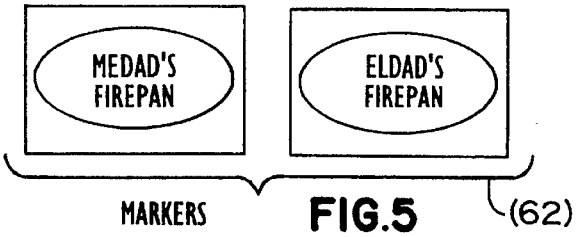
FIG. 5 is a representation of the Markers.

The markers referred to as Firepans (FIG. 5) are three-dimensional pans with the names of Biblical characters.

Figure 6:
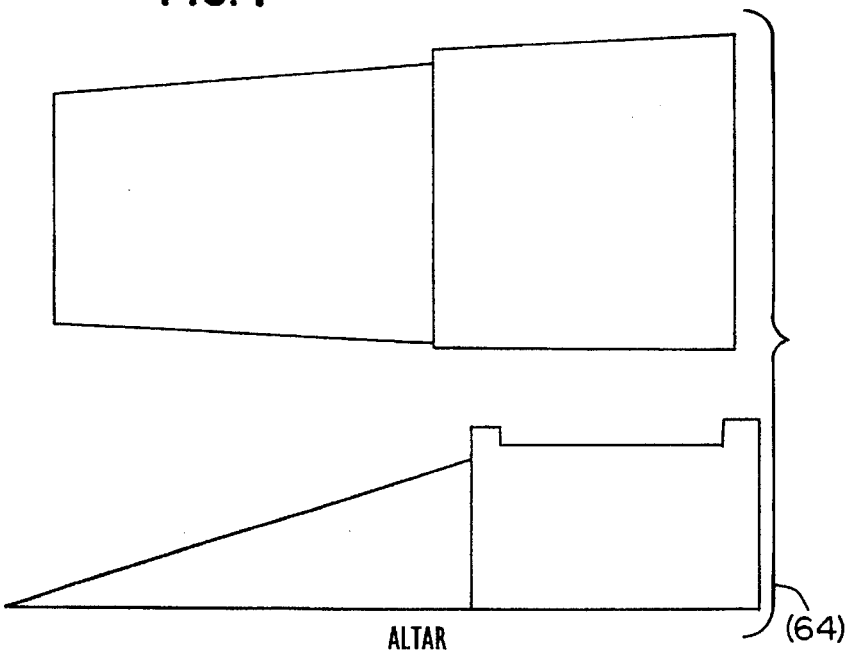
FIG. 6 is a representation of the Altar.

FIG. 6 is a three dimensional model sacrificial altar which consists of a ramp leading to a rectangular platform that should have four horns at each corner. A decorative line (not portrayed) should encircle the altar about half way from top to bottom. The size of the Altar in the preferred embodiment is 7" long×4" wide×3" high. The Altar adds to the realism.

Figure 7:
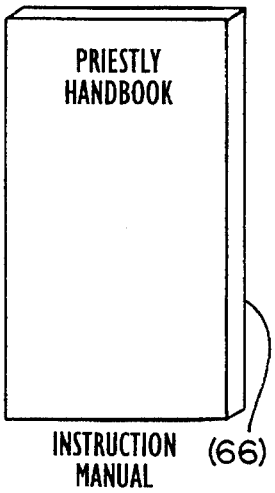
FIG. 7 shows an Instruction Booklet included in the game apparatus.

Turning to FIG. 7 there is revealed an Instruction Manual. The instruction manual, also known as the Priestly Handbook, contains a variety of articles describing various sacrifices and issues of ritual purity. The Handbook contains a plurality of tables which are referenced during the course of the game and which can result in further activity on the game board. An example is the game board event "Leprosy See Instructions." An article is provided giving details of the rituals to performed in case of Leprosy. A table is provided with symptoms which in conjunction with the Oracle (52) returns a diagnosis which requires either no further activity because Leprosy is not indicated or to make the appropriate sacrifices for a Leper.

Figure 8:
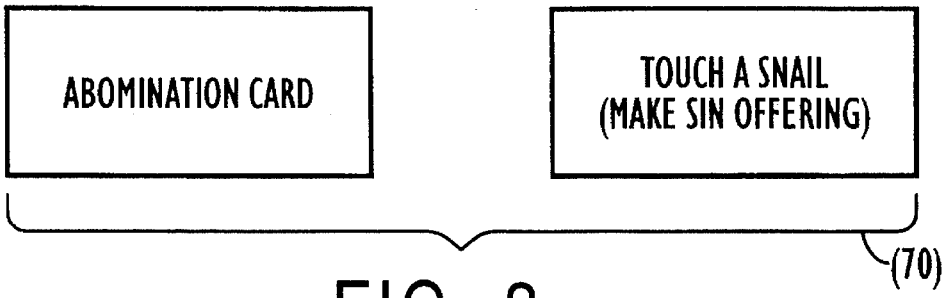
FIG. 8 illustrates the Abomination Cards.

Referring now to FIG. 8 is a card deck referred to as "Abomination Cards." These generally posit some sort of event or circumstance with a negative connotation. If the circumstance is not an explicit abomination then it a questionable event.

Figure 9:
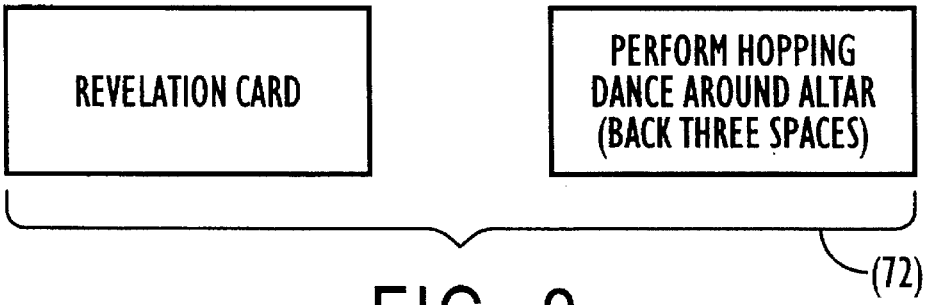
FIG. 9 illustrates the Revelation Cards.

With reference to FIG. 9 the "Revelation Card" deck contains an instruction or an event usually of a relatively benign even if sometimes questionable nature.

Figure 10:
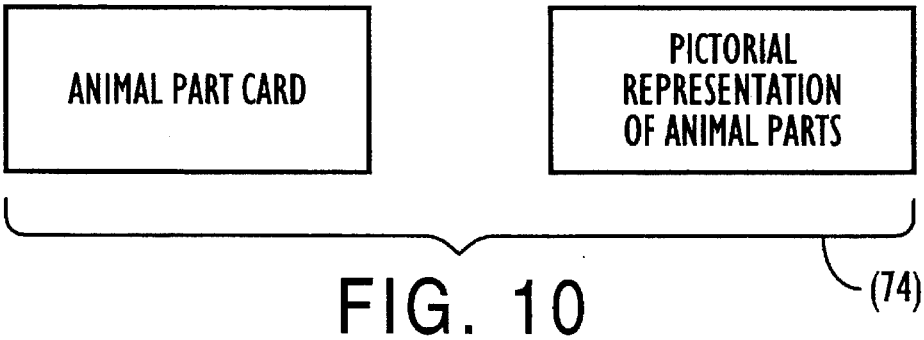
FIG. 10 illustrates the Animal Part Cards.

Animal Part cards FIG. 10, are included for added realism and alternate modes of play.

Figure 11:
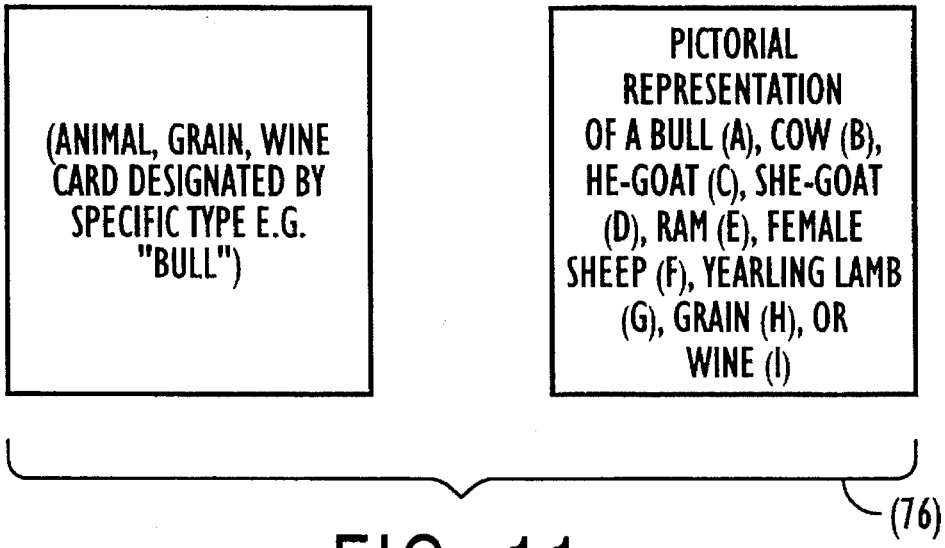
FIG. 11 illustrates the Sacrificial Animal, Grain, and Wine cards.

FIG. 11: Animal, Grain, and Wine cards consist of pictorial representations of the sacrificial animals, grain or wine: These include a Bull, Cow, He-goat, She-goat, Ram, Female Sheep, and a Yearling Lamb, Pigeon, and Turtledove, Sheaf of Grain, Hin of Wine.

PLAY OF THE GAME

The specific objective of the game is not to be consumed by "strange fire" due to a sacrifice not being accepted. Before play begins a High Priest is selected to handle the various sacrifices. A second player is named Money Changer, who handles the monetary transactions such as sale of sacrificial animal, grain, and wine cards (76), and collection of the first and second tithes. Each player selects a token firepan (62) which is used to mark the players position on the board. Firepans (62) are placed on DAY OF THE BLOWING OF THE RAM'S HORN (46) to begin play. A player spins "Thummin" (54) and moves clockwise on the board according to the number spun. Next the player spins "Urim" (56). If a "+" results the activity of the space is executed otherwise no activity occurs and the turn ends. The perimeter path has three categories of spaces: Holyday (44), Non Holyday (46) and Miscellaneous spaces(50). For Non-Holyday space (46) an assortment of activities are suggested such as "Return from Voyage at Sea" or "Obtain Additional Wife" Each event may or may not require a sacrifice. The disposition of any given space is either explicit on the space or indicates the necessity of consulting the Priestly Handbook (66). Holyday spaces are activated when a player lands on the space and "Urim" (56) returns a "+" however unlike the regular spaces the entire community participates in the outcome of the sacrifices with forward, backward or no movement depending on the Oracle (52) Holyday sacrifices are provided at no expense to the players but are assumed to have been purchased with first tithe money. A non-Holyday sacrifice is made by purchasing a Sacrificial Animal Card (74) from the Money Changer and handing the Card to the High Priest who places the card on the Altar (64). The Priest or player spins "Thummim" (54) and "Urim" (56). If "Urim" is "+" the player advances the Firepan (62) according to the number rolled on "Thummim" (54). If "Urim" (56) is "–", the Firepan is moved backward according to the number derived from "Thummim" (54). If "Urim" (56) is "O" then the final outcome is determined by the Table of Sacrifices (58) and "Thummim" (54). The game ends for a player when devoured by "Strange Fire" when specified by the Table of Sacrifices. The last player left is the winner.

What is claimed is:

1. A board game apparatus comprising:

(A) A rectangular game board, including (i) a perimeter and a playing path divided into a plurality of spaces with topics relating to principles in the Books of Leviticus and Numbers and other Biblical books; and (ii) a central area representing the Temple, an Altar, and Temple Courtyard;

(B) A dual aspect chance device;

(C) A plurality of card decks, including (i) A plurality of Revelation Cards having Biblical era activities resulting in some cases in further game processes;

(ii) A plurality of Abomination Cards having Biblical era activities resulting in some cases in further game processes;

(iii) A plurality of Sacrifice Cards having a pictorial representation of various sacrificial animals; and (iv) A plurality of Animal Part Cards having a pictorial representation of the proper method of sacrifice;

(D) A plurality of token firepans used to mark the position of players on the board;

(E) A three dimensional representation of an Altar;

(F) A free standing "Table of Sacrifices"; and (G) An instruction manual.

2. The board game as recited in claim 1, wherein the dual aspect chance device includes (A) a first chance piece referred to as "Thummim" and containing seven sides and numbered from one to seven; and (B) a second chance piece referred to as "Urim" and having three symbols "+", "–", and "O."

3. The board game as recited in claim 1, wherein said plurality of Sacrifice Cards include a plurality of animal, grain, and wine sacrifice cards designated: Animal Part Cards, Bull, Cow, Ram, Female Sheep, Yearling Lamb, He-goat, She-Goat, Turtledove, Pigeon, Sheaf of Grain, and Hin of Wine.

4. The board game as recited in claim 3, wherein a first chance piece is used to determine:

a) movement for each turn;

b) the outcome of various table references; and a second chance piece is used to determine:

c) activation of spaces;

d) activation of the Revelation and Abomination Cards.

e) direction of movement; and f) activation of the Table of Sacrifices.

5. The board game as recited in claim 1, wherein said plurality of card decks including said plurality of Revelation Cards and Abomination Cards contain Biblical era events and instructions.

6. The board game as recited in claim 1, wherein the Table of Sacrifices is printed on cardboard and having supports to create a free standing chart, visible to all players throughout the game.

7. The board game as recited in claim 5, wherein said Table of Sacrifices having indicia of five Sacrifices transliterated into English as "OLAH", "MINCHA", "SHELAMIM", "CHATTAS", "ASHAM".

8. The board game as recited in claim 6, wherein the sacrificial card is placed on the Altar and the oracle is consulted.

9. The board game as recited in claim 1, wherein said board game is molded or constructed so as to have an inclined ramp leading to a rectangular surface with raised corners and a decorative line around the walls dividing top from bottom.

10. The board game as recited in claim 1, wherein said instruction manual containing instructions for the spaces on the board as well articles on related subjects, and tables governing further play.

11. The board game as recited in claim 1, further comprising markers representing firepans.

12. The board game as recited in claim 1, wherein the board game further specifies payment for sacrificial animals, grain and wine.

13. The board game as recited in claim 1, wherein the board game further includes a Leprosy determination table.

14. The board game as recited in claim 1, further requiring community sacrifices when a Holyday is proclaimed.

15. The board game as recited in claim 1, wherein a High Priest and Money Changer are appointed to handle specified duties.

16. The board game as recited in claim 1, wherein the game winner is the last one left in the game.

17. A board game apparatus comprising:

(A) A rectangular game board including:

(i) a perimeter and a playing path divided into a plurality of spaces with topics relating to principles in the Books of Leviticus and Numbers and other biblical books; and (ii) a central area representing the Temple, an Altar, and Temple Courtyard;

(B) A dual aspect chance device;

(C) A plurality of card decks including a plurality of Animal Part Cards having a pictorial representation of the proper method of sacrifice;

(D) A plurality of token firepans used to mark the position of players on the board;

(E) A three dimensional representation of an Altar;

(F) A free standing "Table of Sacrifices"; and (H) An instruction manual.

* * * * *